US007148779B2

(12) United States Patent
Wolfgram

(10) Patent No.: US 7,148,779 B2
(45) Date of Patent: Dec. 12, 2006

(54) PULSE TYPE TRANSFORMER WITH INCREASED COUPLING COEFFICIENT THROUGH CONFIGURATION OF PLURAL PRIMARY WINDINGS

(75) Inventor: Kirk W. Wolfgram, Rochester, MN (US)

(73) Assignee: Wolfgram Industries, Inc., Rochester, MN (US)

( * ) Notice: Subject to any disclaimer, the term of this patent is extended or adjusted under 35 U.S.C. 154(b) by 91 days.

(21) Appl. No.: 10/933,365

(22) Filed: Sep. 3, 2004

(65) Prior Publication Data

US 2006/0049903 A1 Mar. 9, 2006

(51) Int. Cl.
*H01F 29/00* (2006.01)

(52) U.S. Cl. ..... 336/70; 336/180; 336/181

(58) Field of Classification Search ..... 336/84, 336/69, 70, 181–184
See application file for complete search history.

(56) References Cited

U.S. PATENT DOCUMENTS 2,412,893 A * 12/1946 Lee ..... 333/20
4,518,941 A * 5/1985 Harada ..... 336/69
4,795,945 A * 1/1989 Mayer ..... 315/276

* cited by examiner

*Primary Examiner*—Anh Mai

(57) ABSTRACT

The present invention provides a low duty cycle, high current DC pulse type transformer with increased coupling coefficient between the primary and secondary windings by changing the proximity of the primary windings to the secondary windings through a plurality of primary windings separated by layers of secondary windings thus reducing the average distance between the primary windings and secondary windings. In addition to the increased coupling coefficient, the invention provides a reduction in electrical potential between primary windings and secondary windings through an electrical connection between the primary winding and a tap within the secondary winding. The invention significantly increases the coupling coefficient in applications where the transformer's core becomes saturated due to the high peak current typically found in capacitive discharge type circuits such as those used in electric fence controllers, strobe circuits, and high performance ignition systems for automobile, marine, or motorcycle engines.

2 Claims, 6 Drawing Sheets

PULSE TYPE TRANSFORMER WITH INCREASED COUPLING COEFFICIENT THROUGH CONFIGURATION OF PLURAL PRIMARY WINDINGS

FIELD OF INVENTION

The present invention relates to a high current DC pulse type transformer for use in a high current pulse type application such as a capacitive discharge type circuit, and in particular, to the use of plural primary windings, their physical proximity in relation to the transformer's secondary windings, and the elimination of any primary to secondary isolation by means of an electrical connection of the secondary winding to the primary winding.

BACKGROUND OF THE INVENTION

Transformers are electrical devices typically used to supply power or a signal from an AC source to an AC load. They may also be used to electrically isolate the supply from the load. Transformers consist of at least one primary or input winding along with at least one secondary or output Winding which are electrically coupled to each other by means of a magnetic material and/or through the air. The relationship between the output power provided from the secondary winding in reference to the input power provided to the primary winding is referred to as the coupling coefficient. The coupling coefficient can be controlled through change in the transformer's core material or core size, through change in winding material, number of turns, or winding size, through proximity of the primary windings to the core, proximity of the core to the secondary windings, or proximity of the primary windings to the secondary windings, along with a change to several other parameters. Transformers are typically referred to as AC devices but can be used in a DC pulse application where an electric pulse into a transformer's primary winding causes a change in the magnetic field allowing the transformer to function.

In the AC applications the primary winding's physical proximity to the secondary winding has a significant effect on the transformer's coupling coefficient in high frequency applications where the transformer is provided without a magnetic core and where all coupling between the primary winding and secondary winding is through the air. In low frequency applications such as power supplies, transformers are typically provided with a magnetic core that magnetically couples the primary winding to the core and then couples the core to the secondary winding. In these AC applications involving a magnetic core, the proximity of the primary windings to the secondary windings has little effect on the transformer's coupling coefficient allowing transformers to be constructed with a wide variety of configurations including transformers with the primary and secondary winding on a common leg of the magnetic core and transformers with the primary and secondary winding on different legs of the core. Although the primary winding's proximity to the secondary has little effect on the coupling coefficient in these types of AC transformers, very large AC transformers such as those used by electric utilities may be designed with the primary winding in multiple layers separated by layers of the secondary winding to place as many primary turns in physical proximity to the secondary winding's turns. This construction of alternating primary and secondary layers adds to the design and manufacturing expense but allows the transformer's efficiency to exceed 99.5%. Although this multiple layer construction is not common in most transformers and adds cost to the transformer, the cost is offset by the energy the utility company saves from the large amount of power involved and the transformer's higher efficiency.

In DC pulse applications, transformers are typically constructed with a magnetic core and the transformer behaves similar to the AC application as long as the pulse current does not become so high that the magnetic core is pushed beyond saturation. Pushing the transformer's core beyond saturation in DC pulse type applications is not common in circuit types such as DC to DC converters. However, saturation of the core is common in high current DC pulse type applications such as capacitive discharge circuits when the duration of input pulse current is small relative to the time between pulses. This relation of duration of input pulse current to duration of time between input current pulses is called the duty cycle. For an AC transformer that is operated continuously, the duty cycle would be 100%. For a DC pulse type transformer where the transformer is used in a high current application such as a capacitive discharge circuit where there is a long time between the pulse currents (typically while a capacitor is charged) relative to the duration of the pulse current (or during the capacitor's discharge), the duty cycle would be significantly lower than 100%. Due to this lower duty cycle, transformers used in this type of high current DC pulse type application have time to cool between pulses and can be significantly smaller than a transformer designed to deliver the same peak output power continuously. The smaller size and the high currents associated with capacitive discharge type circuits cause the magnetic core in the high current DC pulse type transformer become saturated such that very little increase in output power from the secondary winding is delivered for an increase in input power to the primary winding due to the magnetic coupling through the transformer's magnetic core. While the coupling coefficient in an AC transformer with a magnetic used in power applications has very little dependence on the primary winding's proximity to the secondary winding, the coupling coefficient in the high current DC pulse type transformer becomes more dependent on the primary winding's proximity to the secondary winding as the core becomes more saturated. In applications such as an electric fence controller, a transformer used in a capacitive discharge circuit may have a peak output power of over 100 kilowatts where it's physically size may only be adequate to deliver 50 watts in an AC application with a 100% duty cycle. Even with the high peak power present and extremely saturated core in this type of capacitive discharge application, transformer efficiencies of over 75% can be achieved provided a significant percentage of the coupling coefficient is due to the primary winding's physical proximity to the secondary winding.

While it is beneficial with regards to the coupling coefficient in a high current DC pulse type transformer to have primary winding in close physical proximity to the secondary winding, regulatory requirements, physical construction problems, cost, dielectric requirements, and physical size of the high current pulse type transformer cause the primary winding to be physically separated from the secondary winding.

In applications such as an electric fence controller, regulatory requirements are described by safety agencies such as Underwriters Laboratories, Inc. Publication CL96 (Standard for Safety for Electric Fence Controllers) which state the output from the product must be isolated from the supply circuit for AC powered products to keep the end user from becoming electrocuted due to the AC supply voltage being passed directly to an electric fence which is connected to the output of the product. CL69 defines acceptable transformer construction methods including insulation types and thicknesses depending on the method of construction which are necessary for isolation but keep the primary winding physically separated from the secondary winding.

Although not as common, some electric fence controllers use two transformers, one input transformer to provide isolation and one output transformer used in a high current pulse application or capacitive discharge circuit. While the output transformer does not have the requirement of providing isolation, construction methods remain similar to transformers that provide isolation due to physical construction problems. The output transformer in the electric fence controller is a step up transformer typically having an output voltage of 10,000 volts. The step up transformer construction typically has an input or primary winding of several turns using a large diameter wire and an output or secondary winding with ten to fifty times as many turns as the primary winding using a wire diameter that is much smaller than the primary winding. To make the primary and secondary wire lay even during the manufacturing process, separate bobbins for the primary and secondary are used or insulation is provided between the primary and secondary winding to provide an even surface for the outside winding. While these construction methods help keep the cost down in the manufacturing, they cause physical separation between the primary and secondary winding reducing the coupling coefficient.

In applications such as high performance ignition systems where the high current DC pulse type transformer is supplied by a capacitive discharge circuit, the output of the transformer can be over five times the output voltage of the electric fence controller (over 50,000 volts). Due to the dielectric requirements, several layers of insulation or multiple winding bays in a bobbin are typically used to separate high voltage windings from low voltage windings. These construction methods as in the electric fence controller transformer also cause separation between the primary winding and the secondary winding causing the same type of reduction coupling coefficient as seen in the electric fence controller transformer.

While the small physical size of the high current DC pulse type transformer is beneficial to a lower manufacturing cost and is possible due to the low duty cycle which gives the transformer the ability to cool between pulse currents, the small size also helps in the transformer's performance. Because the high current DC pulse type transformer may see hundreds or thousands of amps through the primary winding, the DC resistance of the primary winding very important in the transformer's performance. The smaller size reduces the diameter of each turn allowing the DC resistance to be reduced for a given wire diameter. This reduction in resistance means lower copper loss or less heat is built up inside the transformer resulting in higher transformer efficiency. Thus it would be beneficial to provide a high current DC pulse type transformer with an even smaller size to further reduce the winding diameter and associated DC resistance while providing a construction method that places as many turns as possible in the primary winding in close physical proximity to the turns in the secondary winding. It would also be beneficial to provide such a transformer without isolation to allow closer proximity between the primary and secondary winding and control dielectric problems by providing an electrical connection of the primary winding to the secondary winding in such a manner that the electrical connection connects the primary winding to the secondary winding near the physical location of the primary winding to the secondary winding.

SUMMARY OF THE INVENTION

The present invention provides a high current DC pulse type transformer for use in a high current pulse type circuit such as a capacitive discharge circuit where the core becomes saturated with a construction method for increasing the transformer's coupling coefficient. The coupling coefficient is increased through multiple layers of primary windings, multiple layers of secondary windings, and their proximity to each other along with elimination of any primary to secondary isolation through an electrical connection of the primary winding to the secondary winding to control electric potentials and avoid dielectric problems.

For a given high current DC pulse type transformer where the core is saturated, where the transformer has a given output energy per pulse, and where the transformer has a typical single primary winding with the secondary winding wound in layers around the primary winding, the output energy per pulse may be significantly increased by separating the primary winding into multiple layers where the cross-sectional area of the primary wire in each layer is the original cross-sectional area of the primary wire divided by the number of layers and where each layer is distributed between the layers of secondary windings. For example, for a high current DC pulse type transformer with an extremely saturated core constructed with a single 21 gauge wire for the primary winding where the secondary winding is provided in ten layers wound outside the primary winding, the transformer's efficiency may increase over 25% by changing the single 21 gauge primary winding to three 24 gauge primary windings physically placed between the secondary winding's $3^{Rd.}$ and $4^{th}$, between the secondary winding's $5^{th}$ and $6^{th}$, and between the secondary winding's $7^{th}$ and $8^{th}$ layers. The three layers of primary windings are connected electrically in parallel and have the same DC resistance since the cross-sectional area of a single piece of 24 gauge is ⅓ that of the original 21 gauge wire. The placement of the three primary layers between the secondary layers provides a significant increase in the coupling coefficient without changing the saturation level of the core.

With the primary winding physically placed in the middle and throughout the secondary winding, electric potentials between the primary and secondary windings must be considered. To minimize electric potential between the primary windings and secondary windings, the primary may be electrically connected to the secondary winding at a potential near the physical location of the primary winding within the secondary winding. Since there are more than one primary layer and all primary layers are electrically connected in parallel, the primary may only be connected to one potential within the secondary winding. Optimal location for the electrical connection between the primary and secondary windings is at the center primary winding or between the center two windings if an even number of primary windings is used. Because the primary is directly connected to the secondary winding at a potential other than one of the secondary winding's outputs, the primary circuit must be allowed to electrically float.

The primary winding may be electrically connected to one point on the secondary winding or may be electrically connected in series within the secondary winding. While both configurations control electrical potential of primary winding relative to the secondary winding, one configuration may be preferred over the other depending on requirements for the transformers output waveform and depending on acceptable failure conditions for the transformer application should one winding open or short.

The higher efficiency associated with the alternating primary and secondary winding layer construction along with the electrical connection of the primary to secondary winding to control electric potential between the primary and secondary may also be used to make the high current DC pulse type transformer smaller by reducing all or part of the efficiency gained. While the multi layer construction costs more, the added efficiency and/or reduced size can make the alternating primary and secondary layer construction feasible in a small inexpensive high current DC pulse type transformer. By balancing the increased efficiency with smaller size and the lower cost associated with the smaller size, the result is a smaller less expensive high current DC pulse type transformer with the same or higher output for use in low duty cycle high current applications such as capacitive discharge circuits used in electric fence controllers, strobe circuits, and high performance ignition systems for automobile, marine, or motorcycle engines.

DETAILED DESCRIPTION OF THE INVENTION

Figure 1:
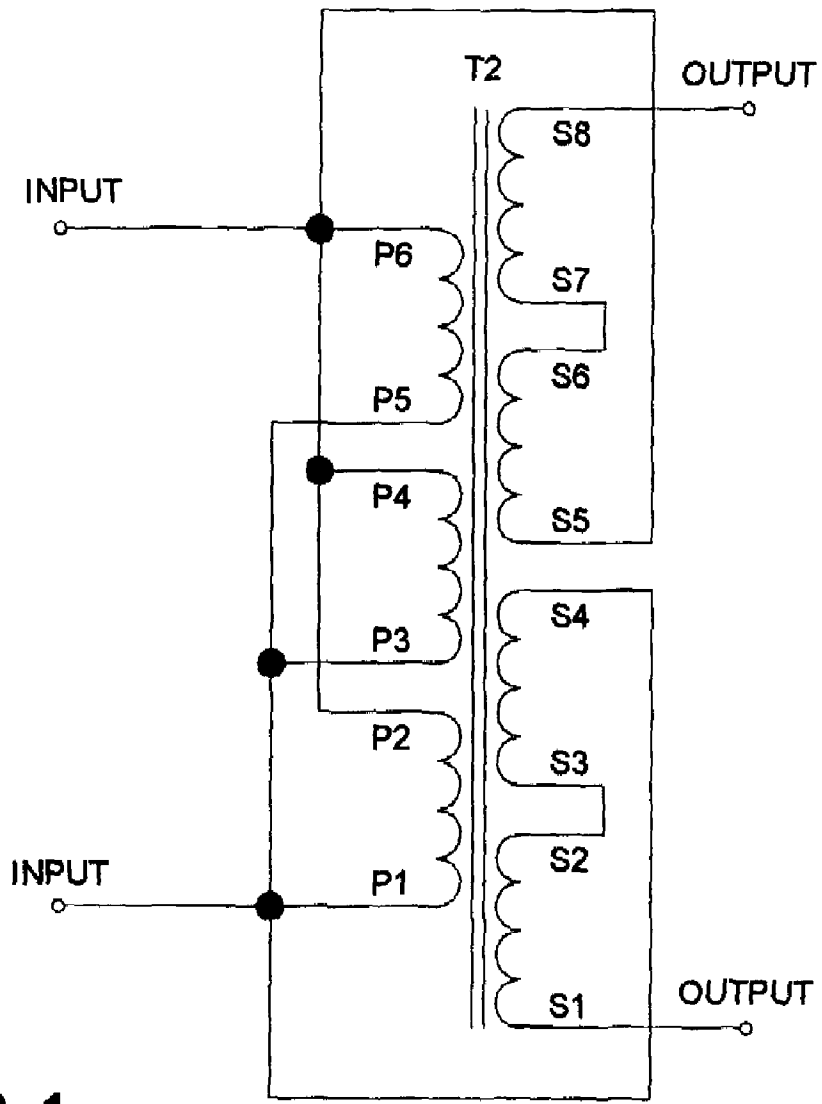
FIG. 1 is a circuit schematic diagram of a preferred embodiment of the high current DC pulse type transformer invention.

FIG. 1 is a circuit schematic diagram showing a preferred embodiment of the high current DC pulse type transformer invention. In FIG. 1, transformer T1 is provided with three primary windings, one winding between terminals P1 and P2, a second winding between terminals P3 and P4, and the third primary winding between terminals P5 and P6. All three primary windings are connected in parallel and connected to the INPUT terminals. In FIG. 1, transformer T1 is provided with four secondary windings, one winding between terminals S1 and S2, a second winding between terminals S3 and S4, a third winding between terminals S5. And S6, and a fourth secondary winding between terminals S7 and S8. All four secondary windings are electrically connected in series with each other and in series with the three parallel primary windings where the primary windings are electrically connected in the middle of the series secondary windings and where the ends of the series circuit is connected to the OUTPUT terminals. While the circuit schematic shown in FIG. 1 shows the electrical connections of the transformer's primary and secondary windings, FIG. 1 does not show the physical construction of the high current DC pulse type transformer.

Figure 2:
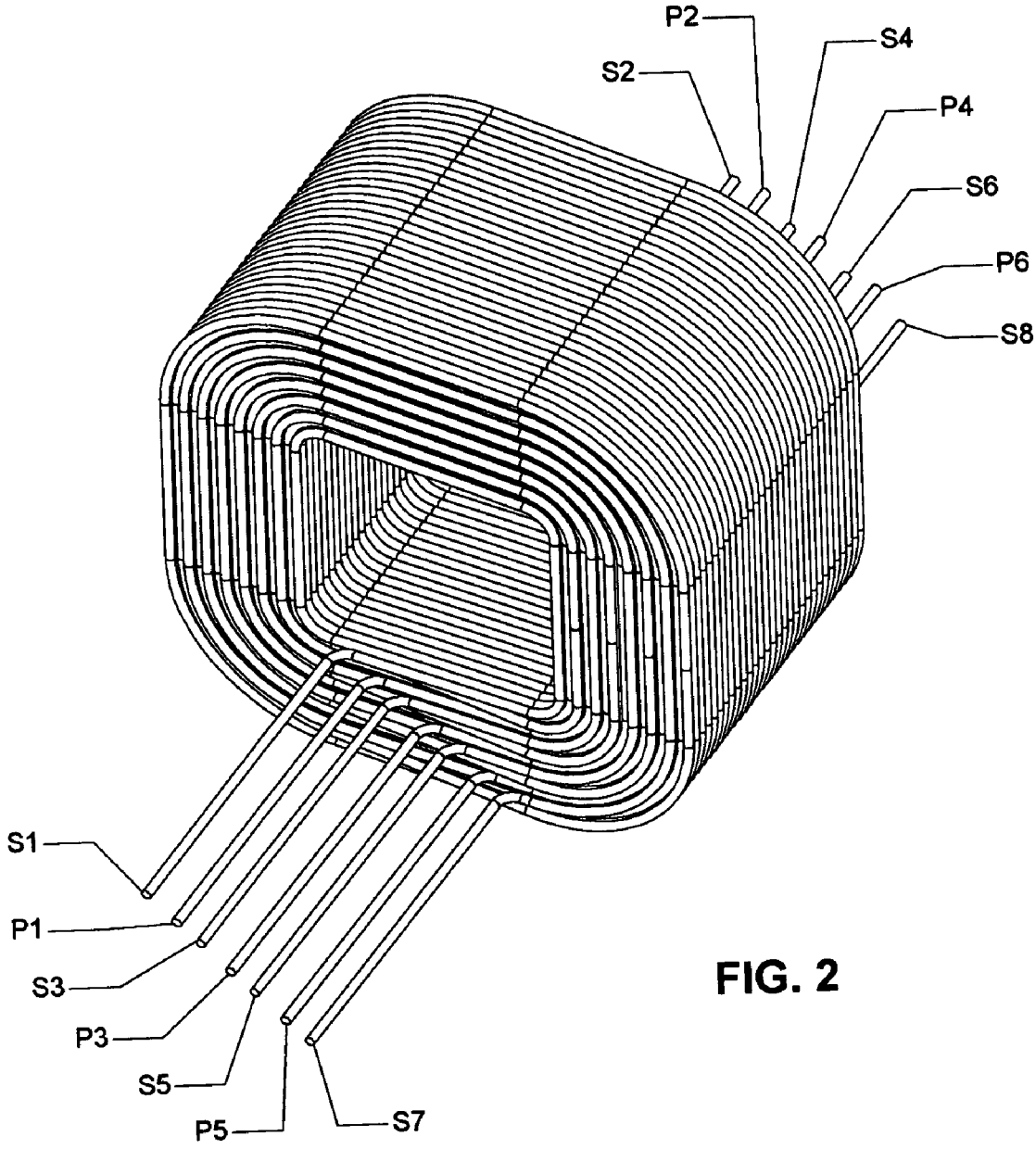
FIG. 2 is an isometric view of a preferred embodiment of the high current DC pulse type transformer invention showing the physical coil construction for the transformer shown in FIG. 1.

FIG. 2. Is an isometric view of a preferred embodiment of the high current DC pulse type transformer showing the physical construction of the transformer's coil from transformer T1 in FIG. 1 along with the transformer's terminals P1, P2, P3, P4, P5, P6., S1, S2, S3, S4, S5, S6, S7 and S8 as they correspond to transformer T1 in FIG. 1.

Figure 3:
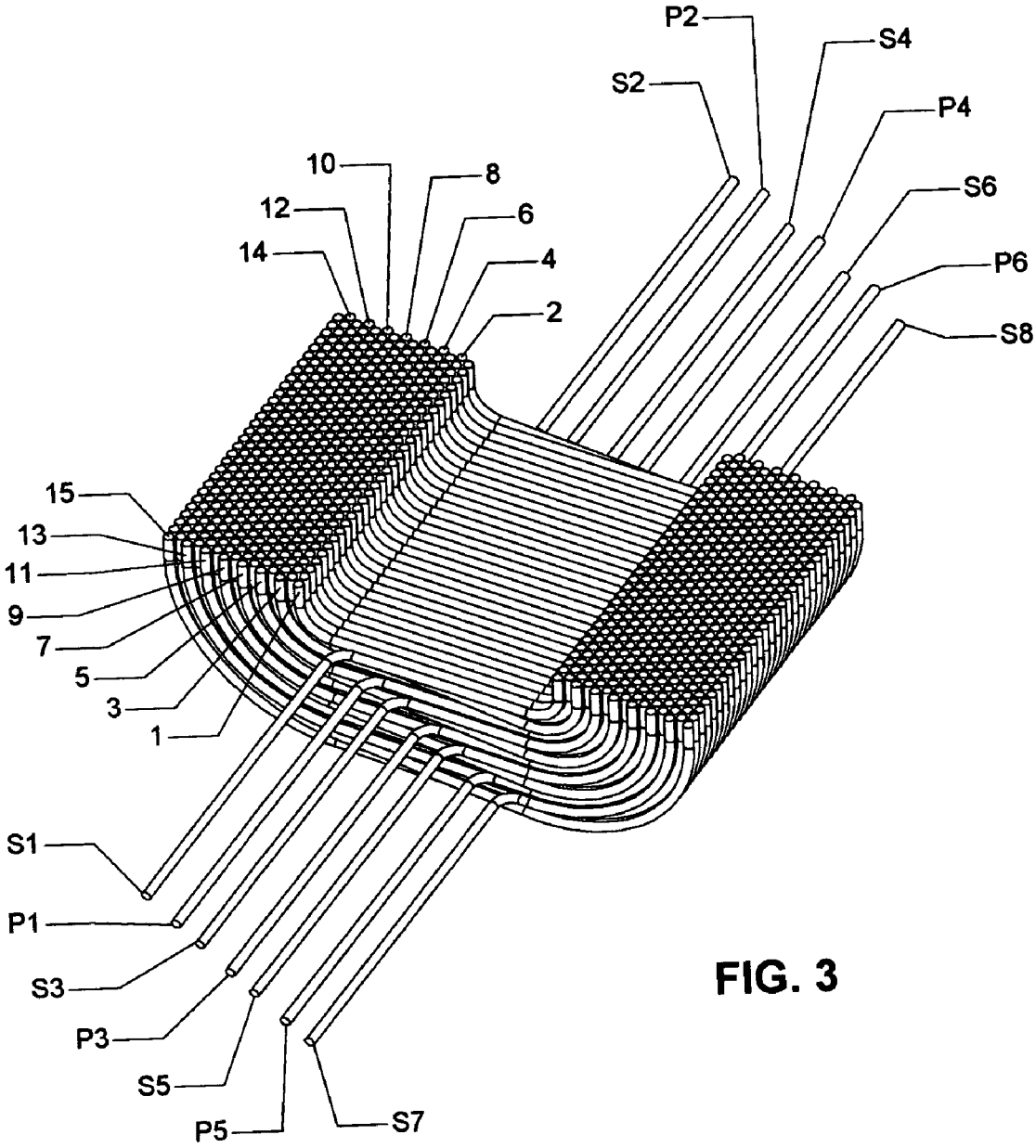
FIG. 3 is an isometric view of a preferred embodiment of the high current DC pulse type transformer invention showing the same as FIG. 2 with the top cut away.
Figure 4:
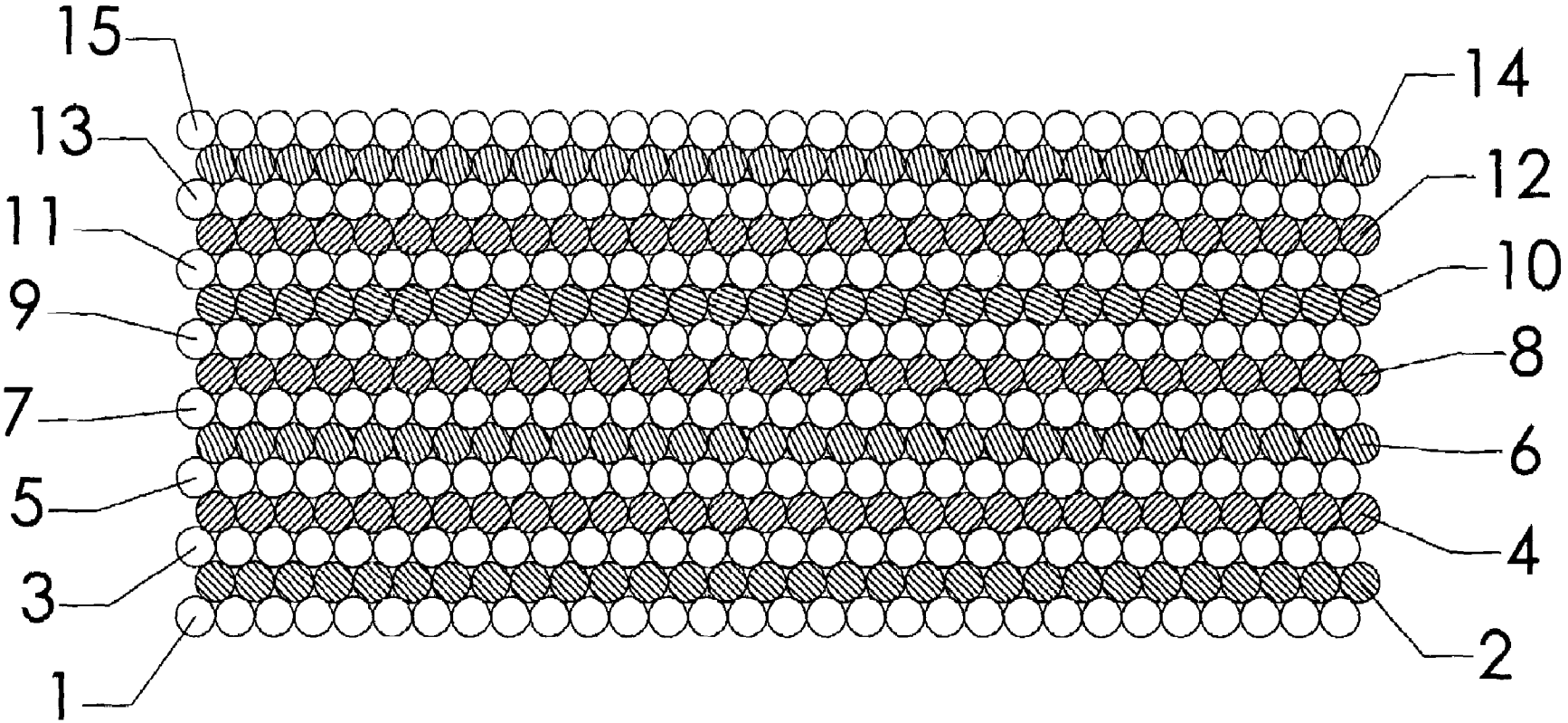
FIG. 4 is a cross-section view of a preferred embodiment of the high current DC pulse type transformer invention showing one side of the sectioned coil shown in FIG. 3.

FIG. 3 shows the same preferred embodiment of the high current DC pulse type transformer shown in FIG. 2 with the top cut away to show the layers of windings within the transformer's construction. FIG. 4 is a cross-section view of the same preferred embodiment of the high current DC pulse type transformer shown in FIG. 3 showing the same cross-section view of the coil in FIG. 3 but larger for clarity.

FIG. 3 also shows the secondary winding between terminals S1 and S2. Being wound around the transformer's core and physically wound in three layers where terminal S1 is connected to the coil's first layer 1, followed by the coil's second layer 2, followed by the coil's third layer 3 which is connected to terminal St. FIG. 3 also shows the coil's first primary winding between terminals P1 and P2 being wound around the transformer's secondary winding in the coil's fourth layer 4.

FIG. 3 also shows the secondary winding between terminals S3 and S4 being wound around the transformer's first primary winding and physically wound in three layers where terminal S3 is connected to the coil's fifth layer 5, followed by the coil's sixth layer 6, followed by the coil's seventh layer 7 which is connected to terminal S4. FIG. 3 goes on to show the second primary winding between terminals P3 and P4 being wound around the transformer's secondary winding in the coil's eighth layer 8.

FIG. 3 also shows the secondary winding between terminals S5. And S6 being wound around the transformer's second primary winding and again physically wound in three layers where terminal S5 is connected to the coil's ninth layer 9, followed by the coil's tenth layer 10, followed by the coil's eleventh layer 11 which is connected to terminal S6. FIG. 3 shows the third and last primary winding between terminals P5 and P6 being wound around the transformer's secondary winding in the coil's twelfth layer 12.

Finally, FIG. 3 shows the secondary winding between terminals S7 and S8 being wound around the transformer's third primary winding and again physically wound in three layers where terminal S7 is connected to the coil's thirteenth layer 13, followed by the coil's fourteenth layer 14, followed by the coil's fifteenth and final layer 15 which is connected to terminal S8.

As shown in FIGS. 2, 3, and 4, the first primary winding connected between terminals P1 and P2 is physically located in the coils fourth layer 4, and is physically located between the secondary windings located in the coil's third layer 3 and the secondary windings located in the coil's fifth layer 5. The second primary winding connected between terminals P3 and P4 is physically located in the coils eighth layer 8, and is physically located between the secondary windings located in the coil's seventh layer 7 and the secondary windings located in the coil's ninth layer 9. The third and last primary winding connected between terminals P5 and P6 is physically located in the coils twelfth layer 12, and is physically located between the secondary windings located in the coil's eleventh layer 11 and the secondary windings located in the coil's thirteenth layer 13. This physical proximity of primary windings to secondary windings provides a significant increase in the coupling coefficient in a high current DC pulse type transformer where the transformer is used in a high current pulse type application such as a capacitive discharge type circuit, and where the core is extremely saturated.

While FIGS. 2, 3, and 4 describe the physical construction of the coil, the mechanical configuration of the primary windings relative to the secondary windings, and the close proximity of the primary windings to the secondary windings, these figures do not show the electrical connection between the windings or address the electric potential between the primary and secondary windings. Referring back to FIG. 1 for the electrical connections, as previously stated, the three parallel primary windings are connected in series with the secondary windings such that the primary winding is electrically connected to the secondary winding near the physical location of the primary winding relative to the secondary winding. This electrical connection of the primary winding to the secondary winding near the physical location of the primary winding within the secondary winding controls the voltage potential between primary and secondary windings. If the primary and secondary windings were not electrically connected, or if the primary and secondary were connected at some other voltage potential than the physical location of the primary winding within the secondary winding, the primary winding will see higher voltages relative to the secondary winding that could result in a dielectric breakdown.

Figure 5:
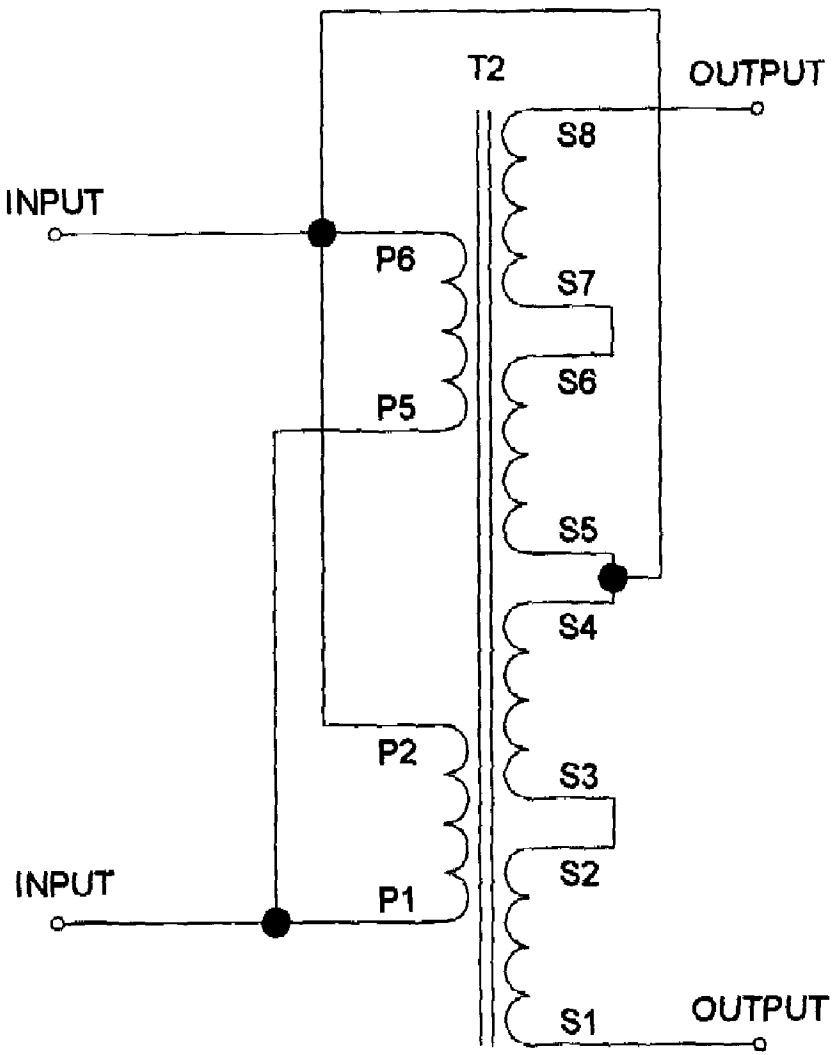
FIG. 5 is a circuit schematic diagram of an alternate embodiment of the high current DC pulse type transformer invention.

FIG. 5 is a circuit schematic diagram showing an alternate embodiment of the high current DC pulse type transformer invention. In FIG. 5, transformer T1 is provided with two primary windings, one winding between terminals P1 and P2, and a second winding between terminals P5 and P6. Both primary windings are connected in parallel and connected to the INPUT terminals. In FIG. 5, transformer T1 is provided with four secondary windings, one winding between terminals S1 and S2, a second winding between terminals S3 and S4, a third winding between terminals S5 and S6, and a fourth secondary winding between terminals S7 and S8. All four secondary windings are electrically connected in series with each other and electrically connected to one side of the primary winding to control the voltage potential between the primary and secondary windings. The ends created by the secondary winding series circuit are connected to the OUTPUT terminals. While the circuit schematic shown in FIG. 5 shows the electrical connections of the transformer's primary and secondary windings, FIG. 5 does not show the physical construction of the high current DC pulse type transformer.

Figure 6:
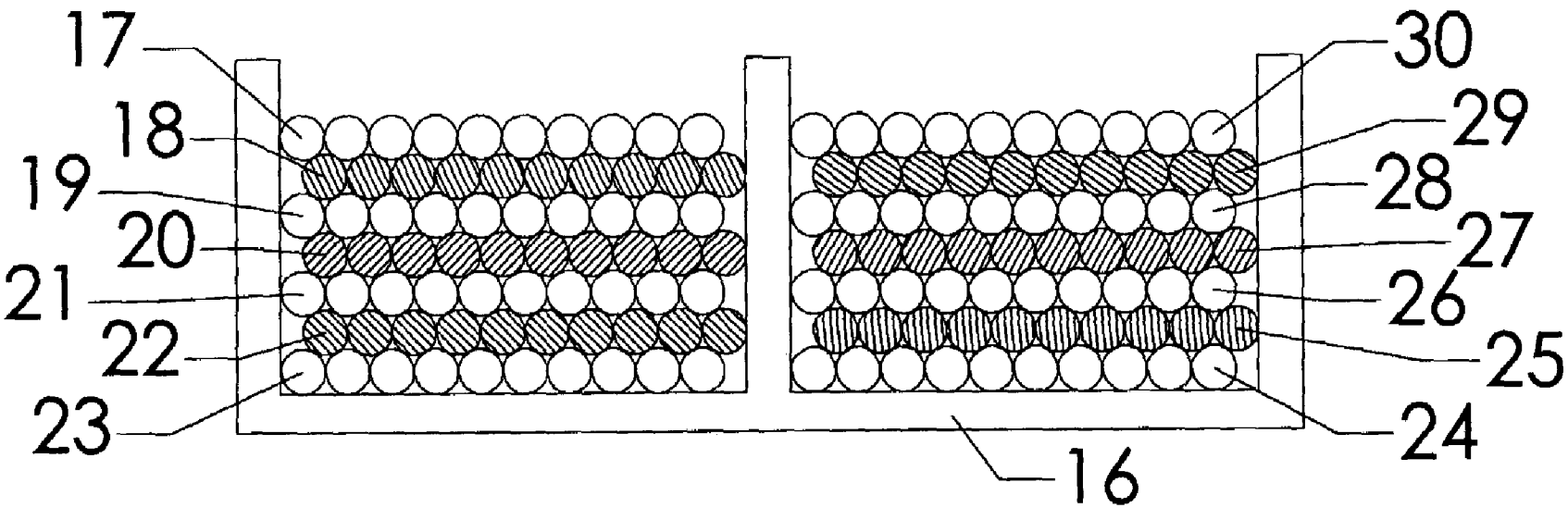
FIG. 6 is a cross-section view of an alternate embodiment of the high current DC pulse type transformer winding showing one side of the sectioned coil for the transformer shown in FIG. 5.

FIG. 6 is a cross-section view of the same preferred embodiment of the high current DC pulse type transformer shown in FIG. 5 showing a cross-section view of the coil and the physical proximity of the primary and secondary windings. In FIG. 6, the coil is shown on a bobbin 16 which is provided with two winding bays. The primary winding between terminals P1 and P2 is located in the middle of one of the bobbin's winding bays in the winding bay's fourth layer 20. The other primary winding between terminals P5 and P6 is located in the middle of the bobbin's other winding bay in the winding bay's fourth layer 27.

The transformer's secondary windings are physically configured such that the secondary winding between terminals S1 and S2 and the secondary winding between terminals S3 and S4 are wound in the same winding bay as the primary winding between terminals P1 and P2 such that terminal S1 is connected to the coil's seventh and outside layer 17 which is wound over the secondary winding in the coils sixth layer 18, which is wound over the secondary winding the coil's fifth layer 19 which is connected to terminal S2 and such that terminal S3 is connected to the coil's third layer 21 which is wound over the secondary winding in the coils second layer 22, which is wound over the secondary winding the coil's first and inside layer 23 which is wound over the bobbin 16 and connected to terminal S4.

The transformer's secondary windings are physically configured such that the secondary winding between terminals S5. and S6. and the secondary winding between terminals S7 and S8 are wound in the same winding bay as the primary winding between terminals P5 and P6 such that terminal S8 is connected to the coil's seventh and outside layer 30 which is wound over the secondary winding in the coils sixth layer 29, which is wound over the secondary winding the coil's fifth layer 28 which is connected to terminal S7 and such that terminal S6 is connected to the coil's third layer 26 which is wound over the secondary winding in the coils second layer 25, which is wound over the secondary winding the coil's first and inside layer 24 which is wound over the bobbin 16 and connected to terminal S5.

As shown in FIG. 6, the first primary winding connected between terminals P1 and P2 is physically located in one winding bay in the coils fourth layer 20, and is physically located between the secondary windings located in the coil's third layer 21 and the secondary windings located in the coil's fifth layer 22. The other primary winding connected between terminals P5 and P6 is physically located in other winding bay and in the coils fourth layer 27, and is physically located between the secondary windings located in the coil's third layer 26 and the secondary windings located in the coil's fifth layer 28. This physical proximity of primary windings to secondary windings provides a significant increase in the coupling coefficient in a high current DC pulse type transformer where the transformer is used in a high current pulse type application such as a capacitive discharge type circuit, and where the core is extremely saturated.

While FIG. 6 describes the physical construction of the coil, the mechanical configuration of the primary windings relative to the secondary windings, and the close proximity of the primary windings to the secondary windings, FIG. 6. Does not shown the electrical connection between the windings or address the electric potential between the primary and secondary windings. Referring back to FIG. 5 for the electrical connections, as previously stated, the two parallel primary windings are connected to the secondary windings such that the primary winding is electrically connected to the secondary winding near the physical location of the primary winding relative to the secondary winding in FIG. 6. This electrical connection of the primary winding to the secondary winding near the physical location of the primary winding within the secondary winding (or at the average voltage potential within the secondary winding) controls the voltage potential between primary and secondary windings. If the primary and secondary windings were not electrically connected, or if the primary and secondary were connected at some other voltage potential than the physical location (or average voltage within the secondary winding) of the primary winding within the secondary winding, the primary winding will see higher voltages relative to the secondary winding that could result in a dielectric breakdown.

While several preferred embodiments of the present invention have been described, it should be understood that various changes, adaptations, and modifications may be made therein without departing from the spirit of the invention and the scope of the appended claims.

What is claimed is:

1. A high current DC pulse type transformer for connection to a high pulse current or capacitive discharge type circuit where the transformer is provided with a plurality of primary windings where:

the primary and secondary windings are wound around a common leg of the transformer's core;

the transformer's core becomes saturated due to the level of pulse current;

the transformer's duty Clyde is significantly small;

the primary windings are electrically connected to the secondary windings;

the primary winding is provided in more than one layer where the layers are physically separated from each by layers of the secondary winding;

an efficiency that exists without the presence of the transformer's core that is significant due to primary winding's proximity to the secondary winding;

where the primary windings are connected to a tap in the secondary windings having an electrical potential lying between the output voltages of the secondary windings.

2. A pulse type transformer of claim 1 where the primary windings are electrically in series with the secondary windings.

* * * * *

UNITED STATES PATENT AND TRADEMARK OFFICE

CERTIFICATE OF CORRECTION

PATENT NO. : 7,148,779 B2
APPLICATION NO. : 10/933365
DATED : December 12, 2006
INVENTOR(S) : Kirk W. Wolfgram It is certified that error appears in the above-identified patent and that said Letters Patent is hereby corrected as shown below:

Claim 1, should read as follows:

Claim 1. A high current DC pulse type transformer for connection to a high pulse current or capacitive discharge type circuit where the transformer is provided with a plurality of primary windings where:

the primary and secondary windings are wound around a common leg of the transformer's core;

the transformer's core becomes saturated due to the level of pulse current;

the transformer's duty cycle is significantly small;

the primary windings are electrically connected to the secondary windings;

the primary winding is provided in more than one layer where the layers are physically separated from each by layers of the secondary winding;

an efficiency that exists without the presence of the transformer's core that is significant due to primary winding's proximity to the secondary winding; and where the primary windings are connected to a tap in the secondary windings having an electrical potential lying between the output voltages of the secondary windings.

Signed and Sealed this

Twenty-eighth Day of August, 2007

JON W. DUDAS
*Director of the United States Patent and Trademark Office*